US005235784A

United States Patent [19]

Oki et al.

[11] Patent Number: 5,235,784

[45] Date of Patent: Aug. 17, 1993

[54] HANDY AIR TOOL

[75] Inventors: Yasumasa Oki; Kinya Nose; Katsunobu Kishi; Kenji Fukuda, all of Tokyo, Japan

[73] Assignee: Nitto Kohki Co., Ltd., Tokyo, Japan

[21] Appl. No.: 774,871

[22] Filed: Oct. 11, 1991

[30] Foreign Application Priority Data

Nov. 6, 1990 [JP] Japan ..... 2-116514[U]
Nov. 6, 1990 [JP] Japan ..... 2-116516[U]
Nov. 6, 1990 [JP] Japan ..... 2-116517[U]

[51] Int. Cl.[5] ..... B24B 23/06
[52] U.S. Cl. ..... 51/170 EB; 51/134.5 F
[58] Field of Search ..... 51/170 EB, 170 R, 134.5 F

[56] References Cited

U.S. PATENT DOCUMENTS 3,611,646 10/1971 Cameron et al. ..... 51/170 EB
3,643,385 2/1972 Mikiya ..... 51/170 EB
4,016,684 4/1977 Urda .
4,754,579 7/1988 Batt ..... 51/170 EB

FOREIGN PATENT DOCUMENTS 48-34080 10/1973 Japan .
54-42307 12/1979 Japan .
61-23739 7/1986 Japan .

*Primary Examiner*—Roscoe V. Parker
*Attorney, Agent, or Firm*—Nixon & Vanderhye

[57] ABSTRACT

A handy air tool has a grip including a cylindrical tool holding section and a valve housing fitted therein. Both tool holding section and valve housing are molded from plastic material. Air supplying and exhausting passages are formed at the time of molding the valve housing and a hole for receiving a control a valve mechanism without requiring finishing. A least portion of air supplying ducts can be formed between the tool holding section and the valve housing. The tool is provided in the tool holding section with a locking mechanism comprising a hook portion extending from the free end of an operating lever toward the grip, and restricting elements for holding the hook portion so as to close a control valve member when it is necessary to keep the tool in a non-operating state. When applied to a grinding belt type air tool, a latch mechanism is provided for selectively retaining a grinding belt in a loosened state and in a tightened state and for preventing the grinding belt supporting member from slipping off a tension bar.

16 Claims, 3 Drawing Sheets

HANDY AIR TOOL

BACKGROUND OF THE INVENTION

1. Field of the Invention

This invention relates to a handy air tool.

2. Description of the Related Art

A convectional handy air tool having an air motor or an air piston used as a driving unit for workpieces comprises a grip and a control valve, housed in the grip for controlling the starting and stopping of the driving unit by selectively opening and closing an air supplying duct and an air exhausting duct provided in the grip, and an operating lever pivoted on the grip for operating the control valve. A handy air tool of this kind is disclosed in Japanese Examined Utility Model Registration Application Publication Sho No. 54-42307 (published on Dec. 8, 1979) and Japanese Examined Utility Model Registration Application Publication Sho No. 61-23739 (published on Jul. 16, 1986).

Since, however, the main body of the conventional air tool including the grip is made of cast iron, the valve chamber for the control valve, the transverse hole for slidably receiving the valve rod of the control valve and the air supplying and exhausting ducts cannot be formed in the main body merely by casting but they must be machined accurately, resulting in increased manufacturing cost.

U.S. Pat. No. 4,016,684 discloses an air tool having a lever lock comprising a contact tab provided in the vicinity of the free end of a control-valve operating lever and a thumb contact designed to allow the contact tab to contact the operating lever under the biasing force of a torsion spring. The lock lever is raised by the operator's thumb against the biasing force of the torsion spring to cause the free end of the contact tab to abut against the operating lever. Thus, the operating lever is prevented from approaching the grip such that the air tool does not unexpectedly start.

When the thumb contact is paced in a locked state or an unlocked state, however, it rubs the surface of the tool body and tends to damage the surface. Further, when the lock lever is locked, the contact tab projects significantly from the tool body and may bump nearby articles and break them.

A general grinding-belt type handy air tool has a grinding belt wound on a pair of pulleys and with tension applied by means of a compression coil. During the attachment, detachment or replacement thereof, the grinding belt is loosened. Japanese Examined Utility Model Registration Application Publication Sho No. 48-34080 (published on Oct. 15, 1973) discloses such a grinder in which a hook provided on one end of an engaging lever pivoted to a tension bar is made engaged with a groove formed in the outer peripheral surface of a housing so as to retain a grinding belt in a loosened state, whereby the grinding belt is detached, attached or replaced.

In a grinder having this belt-loosening mechanism, however, the engaging lever projects from the outer peripheral surface of the housing and inhibits the operation of the grinder in narrow places. Further, when shocks are imposed on the grinder, the engaging lever is likely to be deformed and/or damaged.

SUMMARY OF THE INVENTION

An object of this invention is to provide a handy air tool which can be precisely manufactured precisely at low cost.

Another object of this invention is to provide a handy air tool having a mechanism which can be operated by an operator with one hand holding an operating lever so as to securely maintain a control valve for controlling the amount of compressed air in an open state, which requires a very small floor space, and which can be operated with a single hand without damaging the tool.

A further object of this invention is to provide a handy air tool provided with a belt-loosening mechanism which retains a grinding belt in a loosened state without being adversely affected by the tool's surroundings and sudden shocks.

A handy air tool according to this invention comprises a main body having a housing for installing a driving unit (hereinafter referred to as the "driving-unit housing") and a grip extending from the driving-unit housing and containing a control valve mechanism. The mechanism comprises a valve body for opening/closing the air supplying passageway means of the air driving unit and a valve rod extending through the valve body and biased and extending outwardly from the grip. On the grip is pivoted an operating lever which is pushed into the grip to open the valve body. The grip comprises a tool holding section made of plastic material molded to the driving-unit housing as a body, and a valve housing hermetically fixed in the tool holding section, for housing the valve body so as to be movable together with the valve rod. The air supplying passageway means and an air exhausting passageway means extend through the tool holding section and the valve housing.

Since the grip is formed by molding plastic material, a valve hole, air supplying ducts and air exhausting passageway means can be accurately formed without any finishing. Further, the grip is made up of two parts-the tool holding section and a valve housing fitted therein, simplifying the structure of the grip and thereby reducing the manufacturing cost of the air tool.

It is preferred that the air tool of this invention be provided with an operating-lever locking mechanism comprising a hook portion formed by bending the free end of the operating lever and an engaging member engageable with the hook portion. As long as the lock mechanism is not released, the operating lever continues to be locked and the control valve remains closed. This avoids malfunction of the air tool and ensures its safety.

When the air tool is used as a grinder having a grinding belt, it is preferred that the air tool be provided with a latch mechanism for retaining the grinding belt in a released state. The latch mechanism comprises a hook formed by bending the free end of a guide shoe toward a tension bar by the biasing force of a spring, and an engaging portion formed on the tension bar. Upon releasing the grinding belt by pushing the tension bar into a grinding belt holding member, the hook engages the engaging portion to keep the grinding belt in a released state. Since the hook extends from the front end of the guide shoe toward the tension bar, the hook does not project outwardly from the guide shoe or obstruct the operation of the air tool even in a narrow place, and it cannot be bent or damaged by shocks.

BRIEF DESCRIPTION OF THE DRAWINGS

This invention will be fully understood from the following description by way of embodiments with reference to the accompanying drawings in which.

DETAILED DESCRIPTION OF THE PREFERRED EMBODIMENTS

An explanation will of a grinding belt type air tool will be set forth. However, the air tool is not limited thereto but may be any air tool using another type of machining element, such a disc grinding element.

Figure 1:
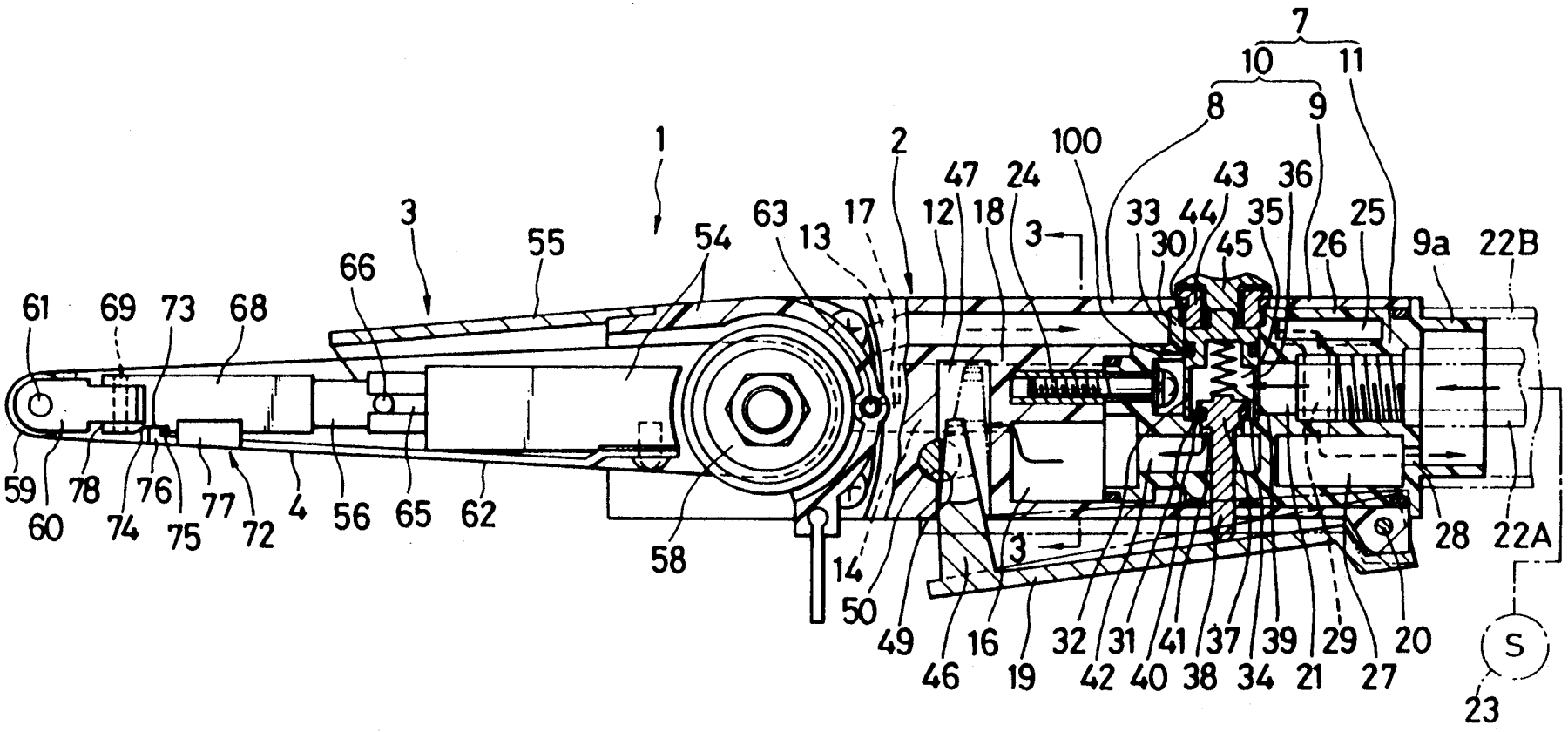
FIG. 1 is a top plan view of one embodiment of a handy air tool according to this invention.
Figure 2:
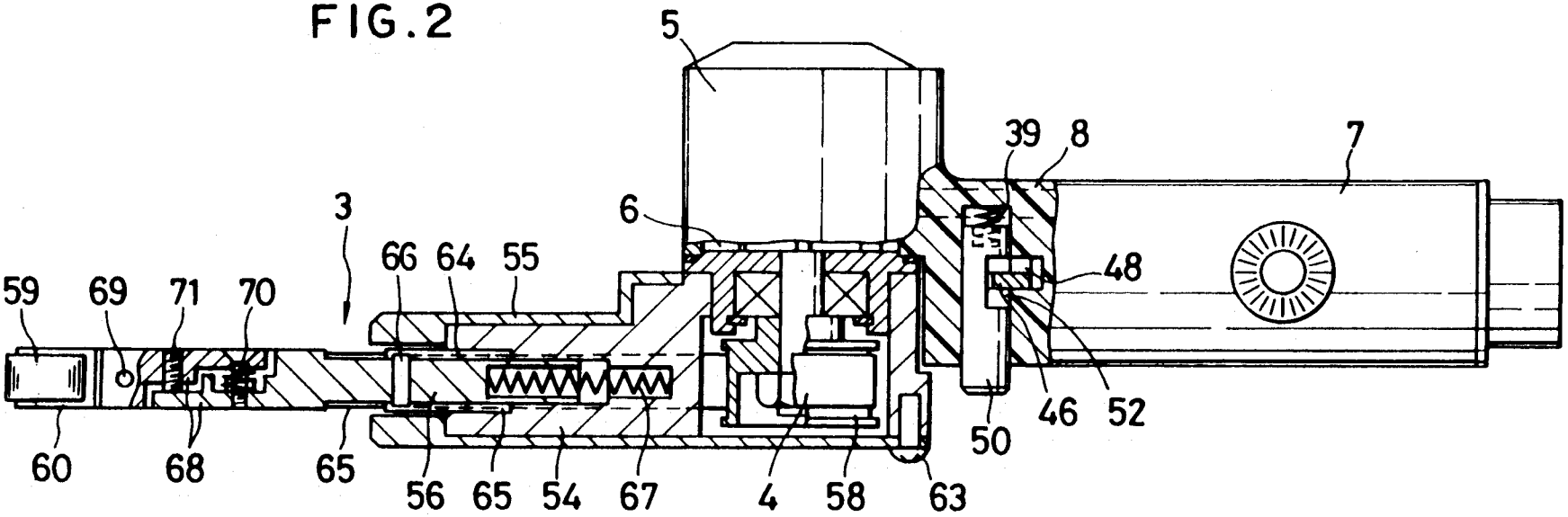
FIG. 2 is a lateral side view of the air tool of FIG. 1, with the main portion of a grinding belt holding portion and a locking mechanism shown in cross section.

Referring to FIGS. 1 and 2, a grinding-belt type handy air tool 1 comprises a main tool body 2 and a machining section 3 on which a grinding belt 4 as a machining element is mounted. The main tool body 1 has a driving-unit housing 5 (FIG. 2) for housing a conventional air motor 6 (FIG. 2) as a pneumatic driving unit, and a grip 7 having a circular or elliptic cross section and extending from one lateral side of the housing 5.

As shown in FIG. 1, the grip 7 comprises: a tool holding section 10 including a pillar portion 8 formed integral with the driving unit housing 5 and extending therefrom, and a tubular portion 9 formed integral with the pillar portion 8 and extending from that portion of the pillar portion 8 which is opposite the driving-unit housing 5; and a pillar-shaped valve housing 11 hermetically fitted in the tubular portion 9.

Figure 3:
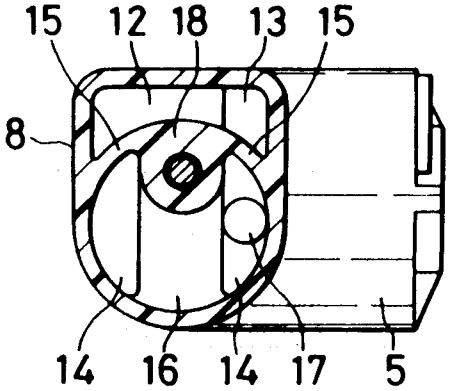
FIG. 3 is a cross-sectional view along line 3—3 in FIG. 1.
Figure 4:
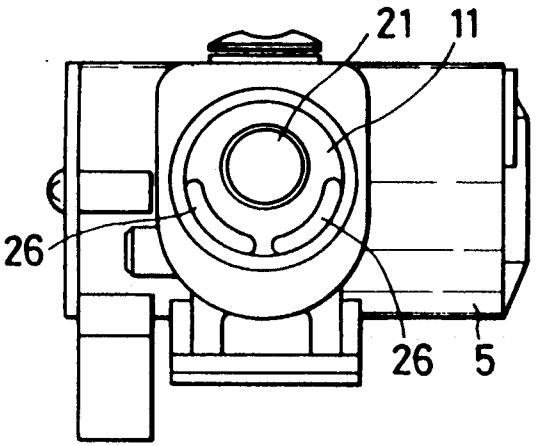
FIG. 4 is a rear view of the handy air tool of FIG. 1.

As shown in FIGS. 1 and 3, a first air exhausting duct 12 having a shallow U-shaped cross section is formed in the upper portion of the pillar portion 8 so as to open at the tubular portion 9. The first air exhausting duct 12 is connected to an air exhaust port of the air motor 6 (which is the driving unit of the grinding belt 4) via an air exhausting hole 13 formed at the side of the air motor 6 in the pillar portion 8. A pair of crescent-shaped first air supplying ducts 14 are separated by a partition rib 15 from the first air exhausting duct 12 (FIG. 3) and arranged side by side in that half of the pillar portion 8 which is at the side of the air motor 6, i.e. the proximal portion of the pillar portion 8. A second air supplying duct 16 having a substantially U-shaped cross section is separated by the partition rib 15 from the first air exhausting ducts 12 and formed in the remaining half of the pillar portion 8 at the side of the tubular portion 9, i.e. the distal portion, such that the second air supplying duct 16 is connected to the first air supplying ducts 14 and opens at the end at the side of tubular portion 9 (FIG. 3). The first air supplying ducts 14 are connected to the air supply port of the air motor 6 via an air supplying hole 17 formed at the end of one of the ducts 14 at the side of the air motor 6. The portion of the distal part of the pillar portion 8 between the first air exhausting duct 12 and the second air supplying duct 16 forms a fixing portion 18 having a substantially elliptic cross section (FIG. 3). One end of an valve-operating lever (hereinafter referred to as the "operating lever") 19 is pivoted by means of a pin 20 on the free end of the tubular portion 9.

As shown in FIG. 1, a cylindrical third air supplying duct 21 extends through the valve housing 11 from one end thereof to the portion of the housing 11 which is close to the other end thereof. The end of the third air supplying duct 21 at the side of the valve housing 11 is connected by means of a coupling to an air supplying hose 22A connected to a pressurized air source 23. The other end of the third air supplying duct 21 is connected to the fixing portion 18 of the pillar portion 8 by means of a fixing screw or fixing bolt 24 inserted in the third air supplying duct 21. A second air exhausting duct 25 is formed in the tubular portion 9 and has the same cross section except for the outer portion where a connecting rib 26 is formed. The duct 25 communicates at one end with the first air exhausting duct 12 and terminates in a blind wall at the other end. In the tubular portion 9 is formed a third air exhausting duct 27 extending in parallel with the second air exhausting duct 25. The third air exhausting duct 27 communicates with the outer atmosphere through air exhausting ports 28 formed in the other end of the valve housing 11 and also communicates with the second air exhausting duct 25 through a connecting passageway 29 formed in the valve housing 11. A flange 9*a* for the air exhausting hose is provided on the free end of the tubular portion 9 so as to surround the air supplying hose 22A and open to its interior. An air exhausting hose 22B surrounds the front portion of the air supplying hose 22A and has one end connected to the flange 9*a* and the other end communicating with the outer atmosphere.

The structure of a control valve mechanism 100 for effecting and interrupting the supply of compressed air from the pressurized air source 23 to the air motor 6 will now be explained. A control valve flange 30 is formed on the surface of the other end of the valve housing 11. In the valve housing 11, a valve hole 31 crosses the third air supplying duct 21 and extends from the opening of the flange 30 substantially to the axis of the valve housing 11. A valve tube 32 is inserted in the valve hole 31 and sealing is made between the valve body 32 and the valve housing 11 by means of an O-ring 33. The valve tube 32 has a blind outer end and an open inner end and is formed therein with a valve chamber 35 having an inner opening 34 opened at the inner end of the valve tube 32 and a lateral notched rectangular or circular notched opening 36 for causing the valve chamber 35 to communicate with the third air supplying duct 21.

A valve body 37 is provided in the valve chamber 35 so as to reciprocate in its axial directions. A valve rod 38 coaxially projects from the valve body 37 to the outside of the tubular portion 9. The inner end face of the valve body 37 is urged by a compression spring 39 provided in the valve chamber 35 such that the tip of the valve rod 38 is always pressed against the rear face of the operating lever 19. A fourth air supplying duct 42 is formed in that portion of the valve housing 11 which is close to the valve chamber 35, and has one blind end and the other end connected to the second air supplying duct 16. The duct 42 communicates with the valve chamber 35 through a communication passageway 41 through which the valve rod 38 extends. An O-ring 40 is fitted on the outer periphery of the valve body 37 so as to seal the communicating passageway 41 from the valve chamber 35 when the operating lever 19 is not operated.

A knob flange 43 is inserted in the control valve flange 30 and connected to the tubular portion 9 by means of an O-ring 44. A knob 45 is loosely inserted in the knob flange 43 and has its inner end fixed onto the outer end of the valve tube 32 in such a manner that the area of the notched opening of the valve tube 32 open to the third air supplying duct 21 is adjusted by rotating the knob 45.

The first to fourth air supplying ducts 14, 16, 21 and 42, the communication passageway 41 and the air supplying hole 17 constitute an air supplying passageway means, and the air exhausting port 13, the first to third air exhausting ducts 12, 25 and 27, the connecting duct 29 and the air exhausting ports 28 constitute an air exhausting passageway means. The pillar portion 8, the tubular portion 9 and the valve housing 11 are manufactured precisely by molding the same plastic material (preferably, polycarbonate) such that post-machining or finishing is unnecessary, as mentioned previously. Further, since sealing members such as O-rings between the pillar portion 8 and the valve housing 11 and between the tubular portion 9 and the valve housing 11 are used, sealing between the tool holding section 10 and the valve housing 11 can be fully carried out even if there are relatively large dimensional errors between them.

An embodiment of a locking mechanism 101 will now be explained with reference to FIGS. 1, 2 and 5 to 8.

Figure 5:
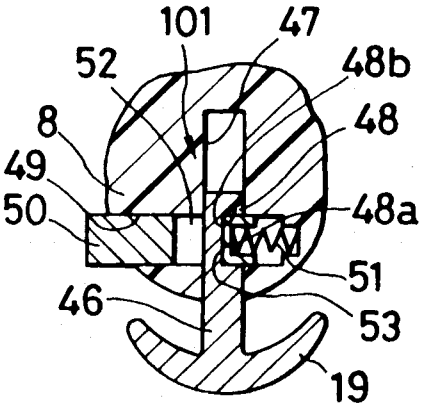
FIG. 5 is a longitudinal cross-sectional view of the locking mechanism of the handy air tool of FIG. 1 in a locked state.
Figure 7:
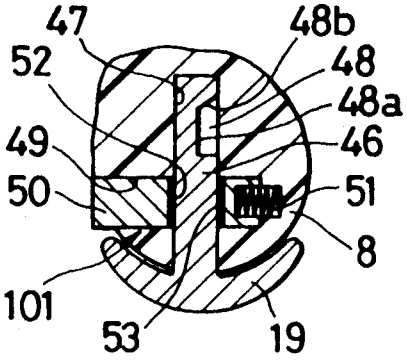
FIG. 7 is a longitudinal cross-sectional view of the locking mechanism of the handy air tool of FIG. 1 in an unlocked state.

As shown in FIG. 1, a hook portion 46 is formed integrally with the operating lever 19 at its free end (the other end) so as to extend substantially normally thereto from the other end (the free end) of the operating lever 19 toward the pillar portion 8. The hook portion 46 has a longitudinal cross section of a high trapezoidal form and a transverse cross section of a rectangular shape and can swing, according to the movement of the operating lever 19, between the position indicated by solid lines and the position indicated by chain lines in a transverse hole 47 formed in the pillar portion 8 and having a rectangular cross section. As shown in FIGS. 5 and 7, an engaging groove 48, having a trapezoidal cross section, is formed in the lateral side of the free end portion of the hook portion 46. The engaging portion 48 includes a bottom wall face 48*a* and an inner side face 48*b*.

As shown in FIGS. 1 and 5 to 8, a transverse hole 49 having a circular cross section is formed in the pillar portion 8. A stop pin 50 is slidably inserted in the transverse hole 49 in a state in which the stop pin 50 projects from the pillar portion 8 by means of a compression spring 51 disposed between the inner end of the stop pin 50 and the bottom end wall of the transverse hole 49. In the inner end portion of the stop pin 50 is formed a transverse through hole 52 whose inner wall is engageable with the lateral wall face of the hook portion 46.

Figure 6:
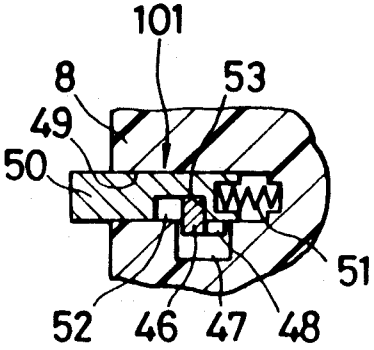
FIG. 6 is a transversal cross-sectional view of the locking mechanism of the handy air tool of FIG. 1 in a locked state.

FIGS. 5 and 6 illustrate the state in which the operating lever 19 is loosened, and the valve body 37 closes the communication passageway 41 and interrupts the supply of compressed air to the air motor 6. In this state, the stop pin 50 engages the engaging groove 48 of the hook portion 46 at the inner wall face 53 of the through hole 52. As long as the stop pin 50 is not pressed into the pillar portion 8, the hook portion 46 is not disengaged from the stop pin 50. Since the operating lever 19 is not moved even if it is erroneously pressed, the grinding belt 4 is not accidentally actuated.

Figure 8:
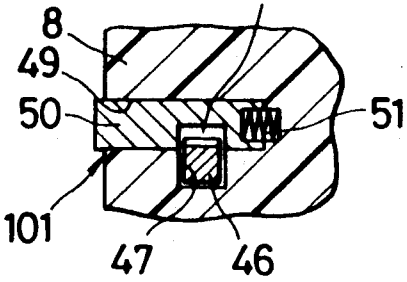
FIG. 8 is a transversal cross-sectional view of the locking mechanism of the handy tool of FIG. 1 in an unlocked state.

When the stop pin 50 is pushed into the pillar portion 8 to cause the engaging groove 48 to align with the through hole 52 as shown in FIGS. 7 and 8, the stop pin 50 disengages from the hook portion 46 such that the hook portion 46 moves in the transverse hole 47 through the through hole 52 of the stop pin 50. As the operating lever 19 is moved toward the grip 7 in the next step, the valve body 37 is moved against the biasing force of the spring 39 via the valve rod 38 and thus the air motor 6 is rotated to drive the grinding belt 4.

The major part of the locking mechanism 101 is in the pillar portion 8, and the hook portion 46, which is the only portion projecting outwardly from the pillar portion 8, extends from the rear face of the operating lever 19 toward the interior of the pillar portion 8. In this regards, the mechanism 101 has no element or part projecting outwardly from the space defined by the outer peripheral surface of the pillar portion 9 and the operating lever 19, so that the grinding operation can be performed without any obstruction, even in a narrow place. Further, the single-hand operability of the operating lever 19 and the stop pin 50 allows the operator to use the other hand for other work.

As shown in FIGS. 1 and 2, the machining section 3 comprises a pillar-shaped supporting member 54 having a rear portion of one lateral side thereof fixed to the inner end of the driving-unit housing 5 and extending in the direction opposite to that of the grip 7, a protector 55 having a U-shaped cross section surrounding the supporting member 54 but opened at the grinding side of the grinding belt 4, a tension bar 56 having a rear portion slidably inserted in the front portion of the supporting member 54, a driving pulley 58 mounted in a recess formed in the rear portion of the supporting member 54 and fixed to the driving shaft of the air motor 6, and a driven pulley 59 rotatably mounted by means of a shaft 61 on a pulley holder 60 provided on the front end of the tension bar 56. The grinding belt 4 is wound on the driving pulley 58 and the driven pulley 59.

The machining section 3 has a guide shoe 62 contacting the rear face of the grinding portion of the grinding belt 4, for holding the same. The guide shoe 62, which is made of a high tensile material and having high elasticity, such a steel, extends substantially along the tension bar 56 and is elastically urged toward it. The rear end of the guide shoe 62 is fixed to the supporting member 54 by means of a screw 63. As shown in FIGS. 1 and 2, two pairs of rail-like guide members 64 extend forward from the front end of the supporting member 54 in such a manner that a guide pin 66 intersects the tension bar 56 and both ends of the guide pin 66 projecting slightly therefrom are inserted in guide grooves 65 defined between the respective pairs of the guide members 64 such that the tension bar 56 is movable lengthwise of the supporting member 54. As shown in FIG. 2, the supporting member 54 is elastically urged by means of a compression spring 67 provided between the inner wall of an elongated hole formed in the rear portion of the tension bar 56.

The pulley holder 60 is rotatably supported by means of a pin 69 on the front section 68 of the tension bar 56. The front section 68 is rotated around the pin 69 as a center of rotation by adjusting screws 70 and 71 in such a manner that the central axis of the driven pulley 59 is made parallel with the central axis of the driving pulley 58 in order that the grinding belt 4 is removed from the driven belt 4.

Figure 9:
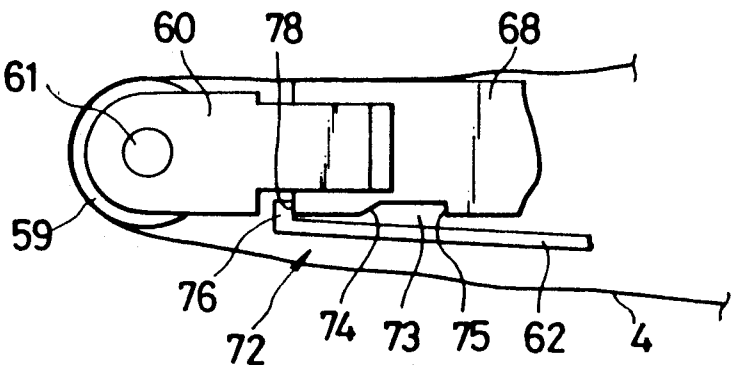
FIG. 9 is a lateral side view of the latch mechanism of the handy air tool of FIG. 1.

With reference to FIGS. 1 and 9, there will now be described the structure of an embodiment of a latch mechanism 72 of this invention.

In the undersurface of the front portion 68 of the tension bar 56 is formed a recessed receiving portion 73 which comprises a bottom face substantially parallel with the lower surface of the tension bar 56, a forward wall face 74 inclined from the upper edge toward the lower edge and a rear face 75 which is substantially perpendicular to the lower face of the tension bar 56.

On the front end of the guide shoe 62 is formed a hook 76 bent substantially at right angles from the guide shoe 62 toward the tension bar 56. Normally, the hook 76 engages the rear face 75 of the receiving portion 68 such that, when the grinding belt 4 is broken, the tension bar 56 is not only prevented from being pulled off the supporting member 54 but also, when the grinding belt 4 is stretched, the distance between the driving pulley 58 and the driven pulley 59 is kept at a required value. A pair of parallel plate-like hook-disengaging pieces 77 (one of which is shown in FIG. 1) are provided on those portions on both sides of the guide shoe 62 which are closest to the hook 76. The front end face 78 of the tension bar 56 constitutes an engaging face parallel with the inner face of the hook 76.

The operation of the air tool of this invention will now be described.

As shown in FIG. 1, the air tool 1 is connected to the compressed air source 23. In this state, as shown in FIGS. 5 and 6, the inner wall face 53 of the stop pin 50 is engaged with the engaging groove 48 of the hook portion 46. Even if the operating lever 19 is pressed toward the grip 7, the stop pin 50 is not disengaged from the hook portion 46, and thus the valve body 38 of the control valve mechanism 100 does not open the communicating passageway 41. In consequence, the grinding belt 4 does not operate accidentally or carelessly.

Next, the grip 7 is held by the operator with one hand, and the stop pin 50 is pushed deep into the transverse hole 52 with the forefinger, for example, against the biasing force of the spring 51 so as to cause the through hole 52 of the stop pin 50 to align with the transverse hole 47, as shown in FIGS. 7 and 8. Thereafter, the operating lever 19 is pushed toward the grip 7. Then, the hook portion 46 is urged into the transverse hole 47 without being interrupted by the stop pin 50. The operating lever 19 is rotated toward the grip 7 and the valve rod 38 is pushed into the valve housing 11 such that the valve body 37 is disengaged from the communication passageway 41. As a result, compressed air is supplied to the air motor 6 through the air supplying hose 22A, the third air supplying duct 21, the valve chamber 35, the communication passageway 41, the fourth air supplying duct 42, the second air supplying duct 16, the first air supplying duct 14 and the air supplying hole 17. The air motor 6 is rotated to drive the grinding belt 4. Air in the air motor 6 is exhausted to the outer atmosphere through the air exhausting hole 13, the first exhausting duct 12, the second exhausting duct 25, the connecting passageway 29, the third air exhausting duct 27, the air exhausting ports 28 and the air exhaust hose 22B. The exhausting hose 22B has sufficient length to ensure that the exhausted air does not obstruct the work and/or is not blown toward the operator.

After the hook portion 46 has been pushed in, the stop pin 50 is released. In this state, the stop pin 50 has already been disengaged from the engaging groove 48 of the hook portion 46 and only contacts the lateral surface of the hook portion 46 by the biasing force of the spring 51 such that the hook portion 46 is easily moved in its axial directions. As a result, the operating lever 19 can be swung freely to control the opening of the valve body 37. Further, the amount of compressed air per unit time supplied to the air motor 6 is controlled by adjusting the movement of the operating lever 19, and still further, its maximum value is regulated by varying the opening area of the notched opening 36 of the valve tube 32 to the third air supplying duct 21 by rotating the knob 45.

After the grinding operation has been completed with the air tool, the operating lever 19 is released. The valve rod 38 is moved together with the valve body 37 toward the operating lever 19 until the operating lever 19 is rotated to the position remotest from the grip 7, as shown in FIG. 1. The valve body 37 completely closes the communication passageway 41 and interrupts the compressed air supply to the air motor 6, whereby the operation of the grinding belt 4 is stopped.

As the operating lever 19 is swung in the return direction, the hook portion 46 is moved in the projecting direction. More specifically, the hook portion 46 begins to slide laterally along the inner wall face of the through hole 52 of the stop pin 50, and then the inclined inner wall face **48*b* of the engaging groove 48 contacts the corresponding edge of the inner wall face 53 of the stop pin 50, and finally, the inner wall face 53 of the stop pin 50 is pushed into the engaging groove 48 by the biasing force of the spring 51 such that the inner wall face 53 is pressed against the bottom wall face 48*a*, as shown in FIGS. 5 and 6. In this way, the tool 1 is returned to the non-operating state. In this state, the air tool 1 cannot be operated as long as the stop pin 50 is pushed into the valve housing 11. Since the inner wall face 48*b* of the engaging groove 48 is inclined, the hook portion 46 is smoothly moved from the position at which it is disengaged from the engaging groove 48** to the position at which it is engaged therewith.

The description will be now made as to how to attach and detach the grinding belt 4 to and from the air tool 1 and to replace the grinding belt 4.

In the state where the air tool 1 is not operated, the pulley holder 60 is held by the operator's fingers and the tension bar 56 is pushed into the supporting member 54 against the biasing force of the spring 67. At the same time, the front end of the hook 76 of the guide shoe 62 slides forward on the bottom wall of the receiving portion 73 and rides over the inclined forward wall face 74 of the receiving portion 73. The front end of the hook 76 further slides forward on the portion of the lower surface of the tension bar 56 between the front end face 78 of the tension bar 68 and the inclined forward wall face 74 of the recessed receiving portion 73 thereof, and finally rides over the front end face 78. When the pulley holder 60 is released in this state, the guide shoe 62 is moved toward the tension bar 56 by its spring force and the hook 76 engages the forward wall face 78. In this case, since the tension bar 56 is kept pushed in the supporting member 54, the grinding belt 4 is kept loosened from the pulleys 58 and 59, as shown in FIG. 9. In the state where the grinding belt 4 is loosened, it can be removed from the pulleys 58 and 59 or replaced with a new one, or a new grinding belt 4 is mounted on the pulleys 58 and 59.

After attachment and replacement of the grinding belt 4, the hook disengaging pieces 77 are held by the operator's fingers and pulled in the direction in which they are separated from the front portion 68 of the tension bar 56. The hook 76 is disengaged from the front portion 78 and the tension bar 56 is moved forward to tighten the grinding belt 4. Next, the hook disengaging pieces 77 are released, and the hook 76 abuts against the rear wall face 75 of the receiving portion 73 by the elastic restoring force of the guide shoe 62 such that the tension bar 56 is restricted at the position shown in FIG. 1. The grinding belt 4 is tightened to a required tension so as to complete the attachment of the grinding belt 4. The inclined front wall face 74 of the receiving portion 73 allows the hook 6 to smoothly slide over the receiving portion toward the front end face 78 of the tension bar 56.

What is claimed is:

1. An air tool comprising:

a main tool body having a driving-unit housing and a grip extending therefrom, said grip comprising a tool holding section integrally formed with said driving-unit housing and a valve housing, said driving-unit housing, said tool holding section and said valve housing being molded from plastic material;

said tool holding section comprising a pillar portion extending from said driving-unit housing and a tubular portion extending from said pillar portion in a direction opposite to said driving-unit housing and hermetically housing said valve housing, said pillar portion being provided at a central portion with a pillar-shaped fixing portion extending lengthwise of said pillar portion, said pillar portion being further provided with fixing means for fixing said valve housing to said fixing portion;

air supplying passageway means and air exhausting passageway means extending through said tool housing and said valve housing;

a control valve provided in said valve housing and comprising a valve body connected to said air supplying passageway means, and a valve rod provided coaxial with said valve body and extending from said tool holder, for selectively opening and closing said valve body;

an operating lever pivoted on said tool holding section, for moving said valve rod such that said valve body is selectively opened and closed; and a pneumatic driving unit housed in said driving-unit housing and connected to said air supplying passageway means and said air exhausting passageway means, for driving a machining element.

2. The tool according to claim 1, wherein said fixing means comprises a fixing screw.

3. The tool according to claim 1, wherein part of said air exhausting passage means is formed between said tubular portion and said valve housing.

4. The tool according to claim 3, wherein said tubular portion has an outer peripheral wall, and said part of said air exhausting portion is formed in said outer peripheral wall of said tubular portion.

5. The tool according to claim 1, wherein said valve body intersects said air supplying passage means.

6. The tool according to claim 1, wherein said plastic material is polycarbonate.

7. An air tool comprising:

a main tool body having a driving-unit housing and a grip extending therefrom, said grip comprising a tool holding section having a transverse hole and integrally formed with said driving-unit housing and a valve housing hermetically fitted in said tool holding section, said driving-unit housing, said tool holding section and said valve housing being molded from plastic material;

air supplying passageway means and air exhausting passageway means extending through said tool housing and said valve housing;

a control valve provided in said valve housing and comprising a valve body connected to said air supplying passageway means, and a valve rod provided coaxial with said valve body and extending from said tool holder, for selectively opening and closing said valve body;

an opening lever pivoted on said tool holding section, for moving said valve rod such that said valve body is selectively opened and closed;

a pneumatic driving unit housed in said driving-unit housing and connected to said air supplying passageway means and said air exhausting passageway means, for driving a machining element; and a locking mechanism including a hook portion extending from said operating lever toward said tool holding section and movable in said transverse hole lengthwise thereof and restricting means provided in said tool holding section to restrict said hook portion when said operating lever is released.

8. The tool according to claim 7, wherein said hook portion is provided in an outer wall thereof with an engaging groove; and said restricting means comprises:

a stop pin intersecting at right angles with said hook portion and movable lengthwise thereof in said tool holding section and capable of extending from said tool holding section; and biasing means for biasing said stop pin in a direction in which said stop pin extends from said tool holding section; and said locking means comprises tightening means provided in said stop pin, for engaging said engaging groove and said operating lever when said operating lever and said stop pin are released.

9. The tool according to claim 8, wherein said locking means comprises an engaging hole formed in said stop pin and allowing said hook portion to extend therethrough so as to align with said transverse hole when said stop pin is released.

10. The tool according to claim 9, wherein said engaging groove has an inclined face which is remote from said operating lever.

11. An air tool comprising:

a main tool body having a driving-unit housing and a grip extending therefrom, said grip comprising a tool holding section integrally formed with said driving-unit housing and a valve housing hermetically fitted in said tool holding section, said driving-unit housing, said tool holding section and said valve housing being molded from plastic material;

air supplying passageway means and air exhausting passageway means extending through said tool housing and said valve housing;

a control valve provided in said valve housing and comprising a valve body connected to said air supplying passageway means, and a valve rod provided coaxial with said valve body and extending from said tool holder, for selectively opening and closing said valve body;

an operating lever pivoted on said tool holding section, for moving said valve rod such that said valve body is selectively opened and closed;

a pneumatic driving unit housed in said driving-unit housing and connected to said air supplying passageway means and said air exhausting passageway means, for driving a machining element;

a machining section including a supporting member having one lateral wall and projecting from said tool holding section in a direction opposite to said grip;

a tension bar having a free end and inserted lengthwise in said supporting member so as to be movable therealong;

biasing means disposed between said supporting member and said tension bar, for biasing said tension bar in a direction in which said tension bar projects from said supporting member;

a guide shoe made of elastic material having one end fixed to said proximal end of said one lateral wall of said supporting member and extending over said tension bar substantially along said lateral wall of said supporting member;

a driving pulley rotatably mounted on said free end of said tension bar;

a grinding belt wound on said driving pulley and said driven pulley and guided by said guide shoe; and latch means provided between said guide shoe and said tension bar, for selectively tightening and loosening said grinding belt.

12. The tool according to claim 11, wherein said guide shoe has another end, and said latch means comprises:

a hook formed on said guide shoe and directed toward said tension bar; and a front end face formed on said tension bar so as to be engaged with said hook when grinding belt is loosened by pushing said tension bar into said supporting member.

13. The tool according to claim 12, wherein said tension bar has a face opposed to said guide shoe, and said latch means includes a groove-shaped receiving portion formed in said face of said tension bar, for receiving said hook when said tension bar is released.

14. The tool according to claim 13, wherein said receiving portion has a wall face formed adjacent to said supporting member and perpendicular to said face of said tension bar.

15. The tool according to claim 11, wherein said receiving portion has an inclined wall face remote from said supporting member.

16. The tool according to claim 11, wherein said latch means has hook disengaging pieces disposed close to the other end of said guide shoe.

* * * * *